US012533559B2

(12) United States Patent
Cheng

(10) Patent No.: US 12,533,559 B2
(45) Date of Patent: Jan. 27, 2026

(54) UNDERFRAME AND GOLF BAG USING THE IMPROVED UNDERFRAME

(71) Applicant: BIN LUNE ENTERPRISE CO., LTD., Miaoli County (TW)

(72) Inventor: Kai-Lun Cheng, Miaoli County (TW)

(73) Assignee: BIN LUNE ENTERPRISE CO., LTD., Miaoli County (TW)

( * ) Notice: Subject to any disclaimer, the term of this patent is extended or adjusted under 35 U.S.C. 154(b) by 137 days.

(21) Appl. No.: 18/538,644

(22) Filed: Dec. 13, 2023

(65) Prior Publication Data

US 2024/0325834 A1 Oct. 3, 2024

(30) Foreign Application Priority Data

Mar. 29, 2023 (TW) ..... 112202905

(51) Int. Cl.
*A63B 55/57* (2015.01)
*A63B 55/00* (2015.01)

(52) U.S. Cl.
CPC ..... *A63B 55/57* (2015.10); *A63B 55/00* (2013.01)

(58) Field of Classification Search
CPC ..... A63B 55/57; A63B 55/00; A63B 55/10; A63B 55/50; A63B 55/53
See application file for complete search history.

(56) References Cited

U.S. PATENT DOCUMENTS 4,181,167 A * 1/1980 Ret ..... A63B 55/40 206/315.6
4,448,305 A * 5/1984 Sup ..... A63B 55/40 206/315.8
4,834,235 A * 5/1989 Solheim ..... A63B 55/57 206/315.7
5,857,567 A 1/1999 Cheng
6,062,383 A * 5/2000 Han ..... A63B 55/57 206/315.3
6,311,937 B1 * 11/2001 Han ..... A63B 55/53 206/315.3
6,311,938 B1 * 11/2001 Lin ..... A63B 55/53 248/96
6,315,117 B1 11/2001 Han
6,386,362 B1 * 5/2002 Cheng ..... A63B 55/57 206/315.3

(Continued)

*Primary Examiner* — Nkeisha Smith
(74) *Attorney, Agent, or Firm* — Demian K. Jackson; Jackson IPG PLLC

(57) ABSTRACT

The present invention provides an improved underframe and the golf bag using the improved underframe, the underframe made of a single elastic material, connected to the bottom side of the golf bag body, for accommodating multiple elastic rods and a supporting frame. The underframe is integrally formed with the elastic material and comprises a base plate, a wall part surrounding the base plate, a first socket, and two second sockets. These sockets are positioned at three locations on the inner side of the wall part to allow insertion of one end of each elastic rod. The first socket is located on one side of the underframe, away from the supporting frame. Additionally, the two sides of the first socket are equipped with two slits extending from the top side of the wall part to the base plate. These slits enable the wall part and the base plate between them to flex elastically.

20 Claims, 5 Drawing Sheets

(56) References Cited

U.S. PATENT DOCUMENTS

| | | | | |
|---|---|---|---|---|
| 6,564,937 | B1 * | 5/2003 | Cheng | A63B 55/00 206/315.3 |
| 6,568,527 | B1 * | 5/2003 | Te-Pin | A63B 55/53 206/315.3 |
| 6,682,027 | B1 * | 1/2004 | Chang | A63B 55/53 206/315.3 |
| 6,938,762 | B2 * | 9/2005 | Cheng | A63B 55/53 206/315.3 |
| 7,445,115 | B2 * | 11/2008 | Tan | A63B 55/00 206/315.7 |
| 7,617,931 | B2 * | 11/2009 | Shiao | A63B 55/53 206/315.7 |
| 7,870,954 | B2 * | 1/2011 | Quartarone, III | A63B 55/53 206/315.3 |
| 8,123,032 | B2 * | 2/2012 | Shiao | A63B 55/53 206/315.7 |
| 8,186,507 | B2 | 5/2012 | Kagen | |
| 8,616,369 | B2 | 12/2013 | Campbell et al. | |
| 8,757,373 | B2 * | 6/2014 | Aubery | A63B 55/00 206/315.7 |
| 9,314,679 | B2 * | 4/2016 | Engel | A63B 55/40 |
| 11,123,616 | B2 * | 9/2021 | Martell | A63B 55/57 |
| 11,752,408 | B2 * | 9/2023 | Zhang | A63B 55/30 248/96 |
| 12,285,665 | B2 * | 4/2025 | Zhang | A63B 55/50 |
| 12,324,968 | B2 * | 6/2025 | Lai | A63B 55/406 |
| 2005/0072696 | A1 * | 4/2005 | Yang | A63B 55/53 206/315.7 |
| 2005/0072697 | A1 * | 4/2005 | Yang | A63B 55/53 206/315.7 |
| 2005/0087463 | A1 * | 4/2005 | Te-Pin | A63B 55/00 206/315.3 |
| 2006/0108244 | A1 * | 5/2006 | Tan | A63B 55/00 206/315.7 |
| 2009/0314671 | A1 * | 12/2009 | Anderson | A63B 55/57 206/315.3 |
| 2011/0005949 | A1 * | 1/2011 | Shiao | A63B 55/53 206/315.7 |
| 2020/0215400 | A1 * | 7/2020 | Martell | A63B 55/53 |
| 2025/0032870 | A1 * | 1/2025 | Zhang | A63B 55/57 |

* cited by examiner

UNDERFRAME AND GOLF BAG USING THE IMPROVED UNDERFRAME

BACKGROUND OF INVENTION

1. Field of the Invention

The present invention relates generally to a golf bag, and more particularly to an improved underframe and the golf bag using the improved underframe.

2. Description of Related Art

Generally, the structure of a conventional golf bag that holds golf clubs comprises a head frame, a base, a plurality of elastic rods connected between the head frame and the base, a bag body enclosing the head frame and the base, a supporting frame connecting the head frame and the base. When the two supporting rods of the supporting frame splay out, they can support the bag body to stand on the ground in a tilted way. The two supporting rods can be retreated to be positioned on one side of the bag body.

When the golf bag stands on the ground in a tilted way, due to the support of the elastic rods, the underframe will only touch the ground only with its edge, resulting in unstable positioning of the golf bag. To improve the stability of the golf bag when standing on the ground in a tilted way, some manufacturers developed a driving plate to be fitted on the underframe. Examples include United States Utility U.S. Pat. No. 8,186,507, No. 6315117 and No. 5857567. The bottom side of the underframe is configured with a tilted surface, so that the bottom of the underframe touches the ground only partially. One end of the driving plate is pivoted to the bottom end of the tilted face of the underframe, and the other end is pivoted to one end of the supporting frame, so that the driving plate can be supported on the ground whether the supporting frame is splayed out or retreated, or whether the underframe is tilted or not. Although the technique of the aforesaid patents can truly improve the stability of the golf bag when standing on the ground in a tilted way, when the golf bag stands on the ground, as the area of the driving plate is small, even with the addition of the part of the underframe that touches the ground, the total area is still smaller than the conventional underframe, the gold bag may topple more easily. Moreover, the assembly of the golf bag becomes more complicated.

In view of this, some manufacturers developed a folding underframe. Examples include United States Utility U.S. Pat. No. 8,616,369, No. 6568527, No. 6386362. The underframe is configured with a folding part. Usually, the material of the folding part is configured to be softer than the material of its two sides. For instance, the folding part and its two sides can be made of materials of different softness, or the thickness of the folding part is less than its two sides (The underframe must be wear-resistant, and has an appropriate rigidity. Therefore, usually two plates with better hardness are attached at intervals to a plate with less hardness, thus forming a folding underframe). In this way, when the golf bag stands on the ground in a tilted way, the underframe can be folded, and when the golf bag stands vertically, the underframe can recover to its original position. Whether it stands in a tilted way or vertically, it is more stable than the aforesaid type with a driving plate.

However, as the manufacturing method of the above folding frame made of different materials is more complicated than the conventional underframe made of one single material, the production cost is high.

SUMMARY OF THE INVENTION

The main object of the present invention is to provide an improved underframe and the golf bag using the improved underframe. The underframe can be folded. It features easy assembly and lower production cost.

In order to accomplish the above object, the present invention provides an improved underframe, connected to the bag body of a golf bag, for fitting a plurality of elastic rods and a supporting frame of the golf bag, made of one single elastic material, comprising a base plate, for support on the ground, a wall part, configured around the base plate, a first socket and two second sockets, configured at three positions on the inner side of the wall part, for insertion of one end of each of the elastic rods, specifically, the first socket is located on one side of the underframe away from the supporting frame, the two sides of the first socket are provided with two slits, the two slits extend from the top side of the wall part to the base plate, so that the first socket, the wall part and the base plate between the two slits can move elastically.

In addition, the invention further provides a golf bag using the improved underframe, comprising the underframe, a head frame, a bag body, a plurality of elastic rods and a supporting frame, the underframe comprising a base plate, for support on the ground, a wall part, configured around the base plate, a first socket and two second sockets, configured at three positions on the inner side of the wall part, for insertion of one end of each of the elastic rods. specifically, the first socket is located on one side of the underframe away from the supporting frame, the two sides of the first socket are provided with two slits, the two slits extend from the top side of the wall part to the base plate, so that the first socket, the wall part and the base plate between the two slits can move elastically, each of the elastic rods being inserted and connected between each of the first, second sockets and the head frame, the bag body being connected between the underframe and the head frame to cover the elastic rods, the supporting frame being configured on one side of the bag body, able to splay out in relation to the bag body to support the bag body to stand on the ground in a tilted way or to be retreated and positioned on one side of the bag body.

BRIEF DESCRIPTION OF THE DRAWINGS

Further detailed descriptions are provided below with respect to a preferred embodiment of the invention, and with reference to the accompanying drawings.

DETAILED DESCRIPTION OF THE INVENTION

Figure 1:
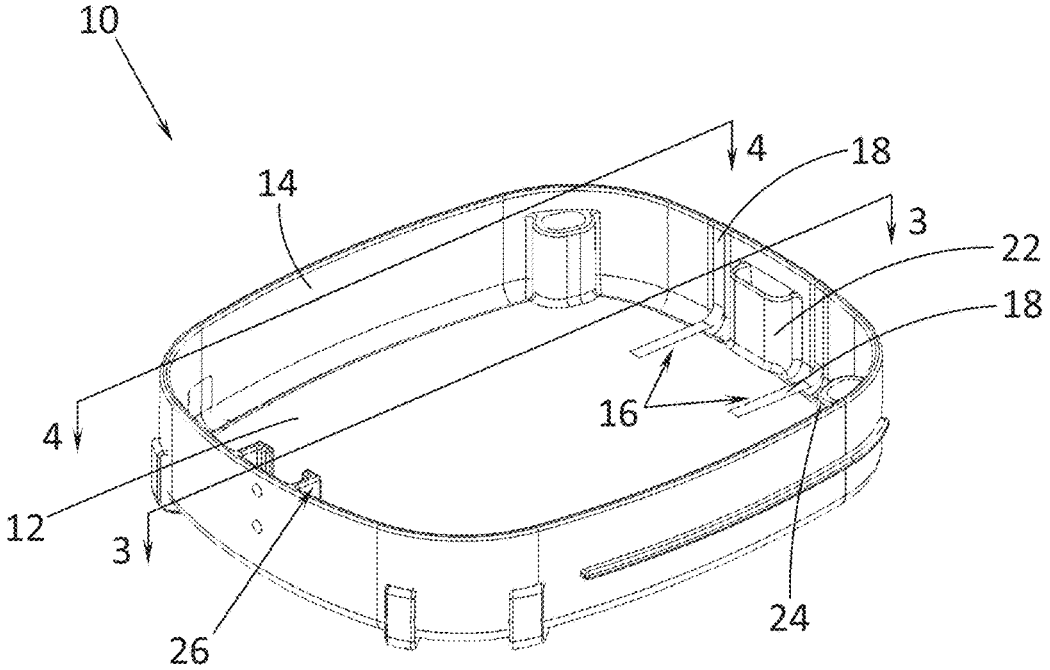
FIG. 1 is a perspective view of the underframe according to a preferred embodiment of the invention.
Figure 2:
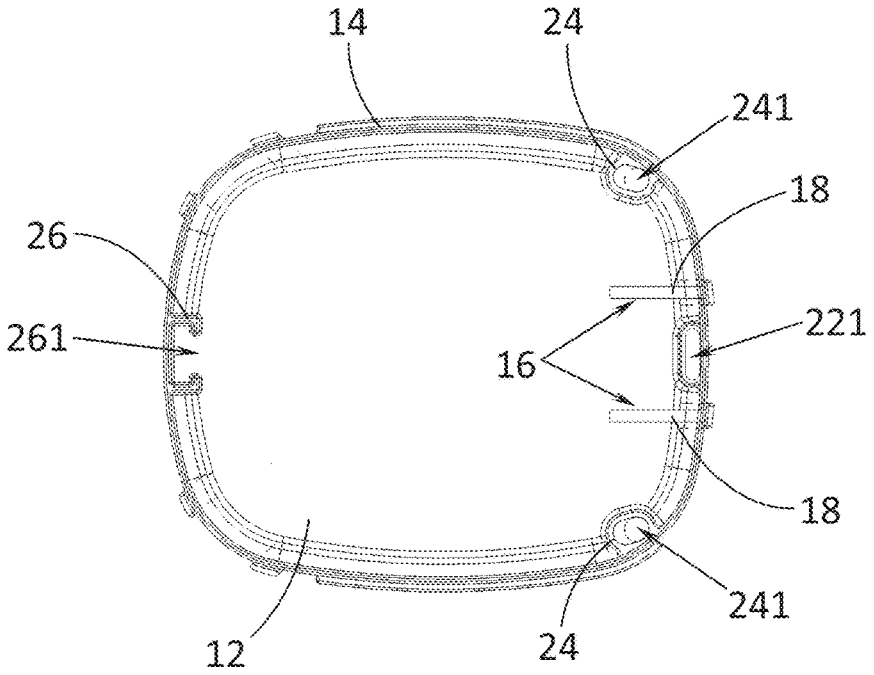
FIG. 2 is a top view of the underframe according to a preferred embodiment of the invention.
Figure 3:
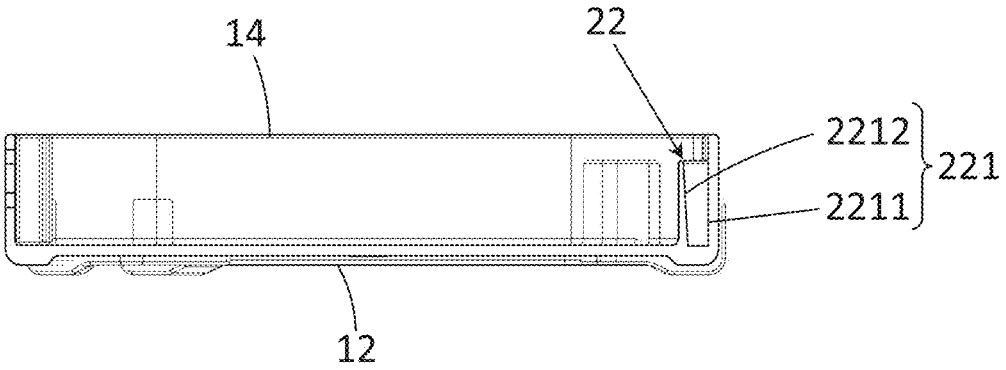
FIG. 3 is a sectional view along 3-3 section line of FIG. 1.
Figure 4:
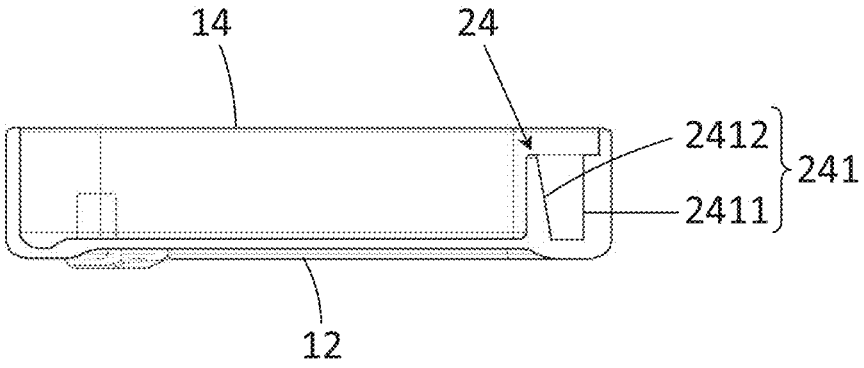
FIG. 4 is a sectional view along 4-4 section line of FIG. 1.
Figure 5:
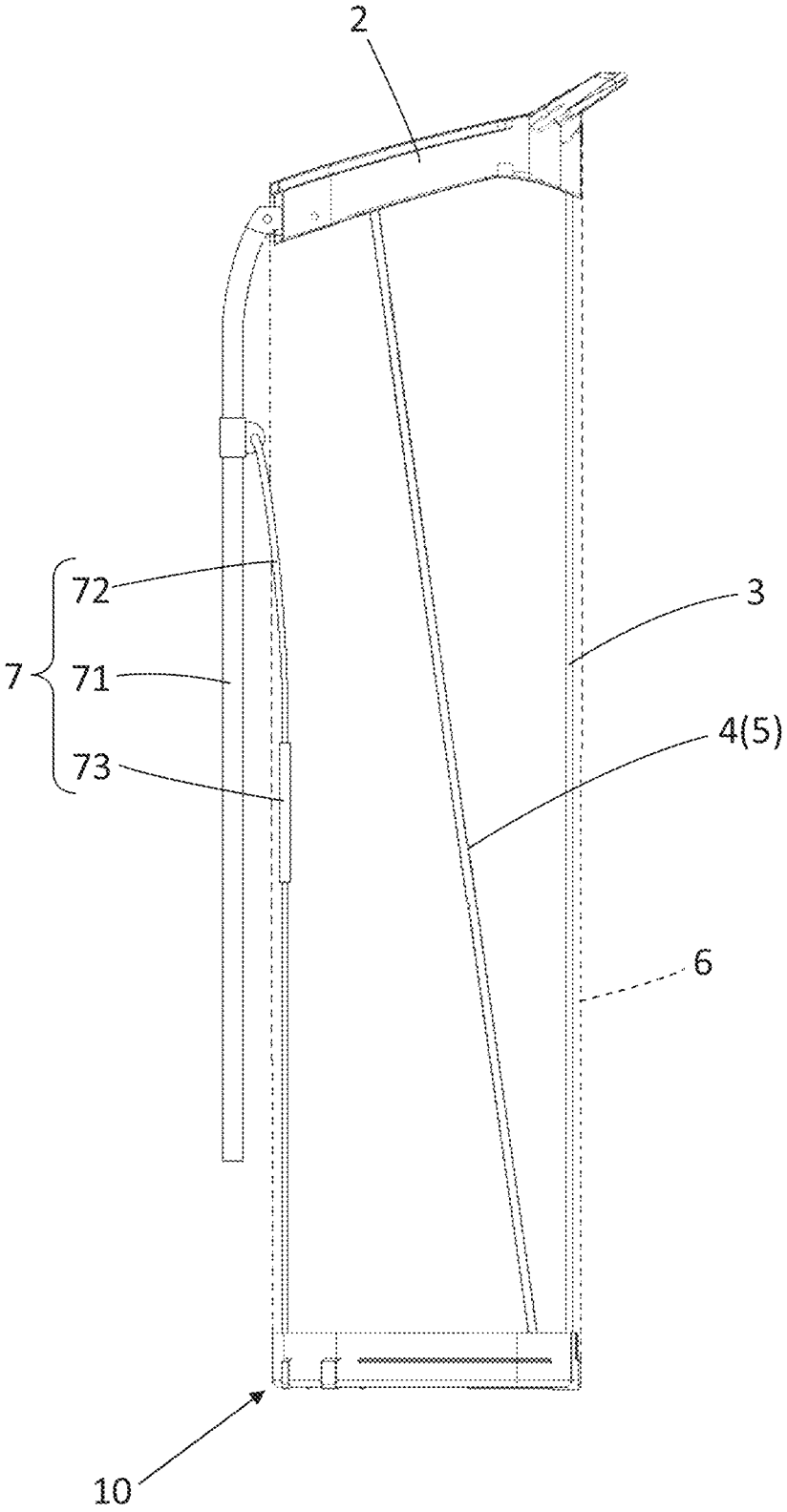
FIG. 5 is a schematic view of the golf bag according to a preferred embodiment of the invention.
Figure 6:
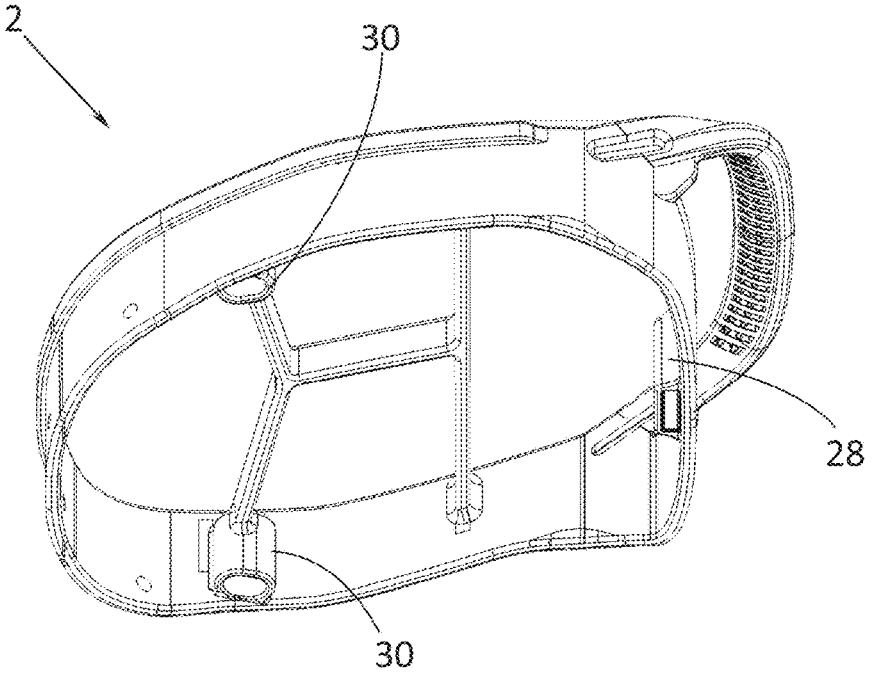
FIG. 6 is a perspective view of the head frame of a golf bag according to a preferred embodiment of the invention.
Figure 7:
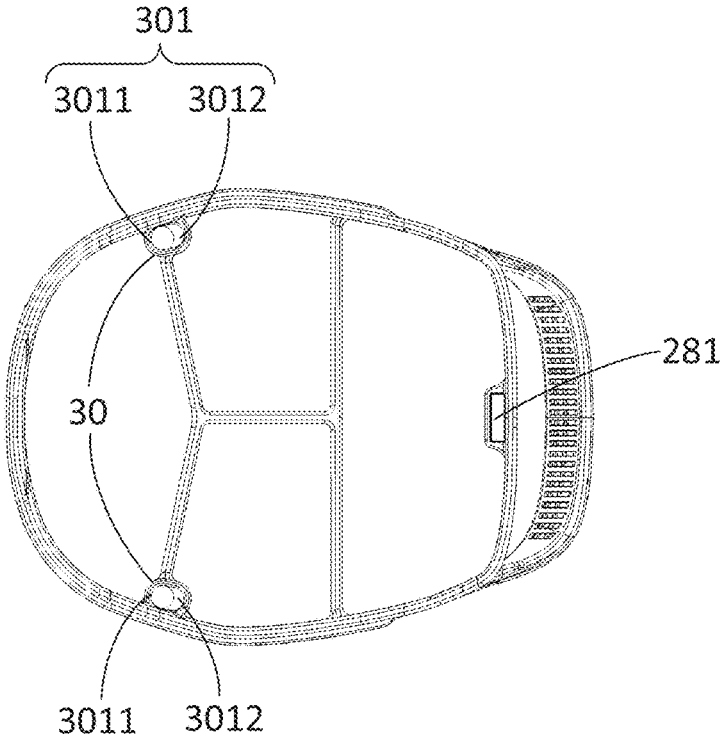
FIG. 7 is a bottom view of the head frame of a golf bag according to a preferred embodiment of the invention.

For better understanding of the invention, a detailed description is provided below with respect to a preferred embodiment and with reference to the accompanying drawings:

First, referring to FIG. 1 to FIG. 7, the underframe 10 according to a preferred embodiment of the invention is used in a golf bag 1. The golf bag 1 comprises an underframe 10 and a head frame 2, a plurality of elastic rods 3, 4, 5, a bag body 6, and a supporting frame 7. Each of the elastic rods 3, 4, 5 is fitted between the underframe 10 and the head frame 2. The bag body 6 connects the underframe 10 and the head frame 2. Its one side is provided with a strap (not shown in the figure). Each of the elastic rods 3, 4, 5 is located on the inner side of the bag body 6. The supporting frame 7 is located on the other side of the bag body 6 opposite to the strap, comprising two supporting rods 71, two elastic bars 72, an insert connection block (not shown in the figure) and a tightening component 73. One end of the two supporting rods 71 is pivoted to the head frame 2. One end of the two elastic bars 72 are relatively pivoted to the two supporting rods 71, and the other end is pivoted to the insert connection block. The insert connection block is inserted in the underframe 10. The tightening component 73 is connected between the two elastic bars 72. The two supporting rods 71 can splay out in relation to the bag body 6 so as to support the bag body 6 to stand on the ground in a tilted way or to be retreated and positioned on one side of the bag body 6. The aforesaid head frame 2, elastic rods 3, 4, 5, bag body 6, and supporting frame 7 are all components of the conventional golf bag and are therefore not detailed herein. The underframe 10 is roughly in the shape of a shell, and is integrally formed with an elastic material, including but not limited to plastic materials. It comprises:

A base plate 12, for support on the ground, a wall part 14, configured around the base plate 12, said wall part 14 configured with one first socket 22 on its inner side, two second sockets 24 and one third socket 26, said first socket 22 located on the side of the underframe 10 away from the supporting frame 7, said first socket 22 and third socket 26 located on the opposite two sides of the underframe 10, said two second sockets 24 positioned between the first socket 22 and the third socket 26 and located on the other two opposite sides of the underframe 10, one insertion hole 221, 241 configured on each of the first and second sockets 22, 24, for insertion by the bottom ends of each of the elastic rods 3, 4, 5, one insertion hole 261 configured on the third socket 26, for insertion by the insert connection block 73.

Further, on the two sides of the first socket 22, two slits 16 are provided, extending from the top side of the wall part 14 to the base plate 12. The direction along the extension of the two slits 16 is perpendicular to the edge of the base plate 12, but with no limitation, so that the first socket 22 between the two slits 16, the wall part 14, and the base plate 12 are not connected with the other parts of the wall part 14 and base plate 12 and can bend elastically. Moreover, to prevent foreign objects or dust from entering from the two slits 16 into the underframe 10, the two slits 16 are configured with two sealing components 18, made of a flexible material such as an elastic material (such as TRP) with its hardness less than that of the underframe 10, but with no limitation, respectively extending from the top side of the wall part 14 to the base plate 12 to block the two slits 16.

Further, the inner wall of the insertion hole 221 of the first socket 22 is further configured with a vertical wall 2211 and a tilted wall 2212, the vertical wall 2211 being perpendicular to the base plate 12, the tilted wall 2212 being tilted toward the supporting frame 7.

Further, the inner side of the head frame 2 is configured with a fourth socket 28 and two fifth sockets 30 respectively corresponding to the first socket 22 and each of the second sockets 24. Each of the elastic rods 3, 4, 5 are inserted between the insertion holes 281, 301 configured on each of the fourth and fifth sockets 28, 30 and the insertion holes 221, 241 of the first and second sockets 22, 24. Each of the second sockets 24 and fifth sockets 30 can be configured to opposite each other in a tilted way (with each of the fifth sockets 30 closer to the supporting frame 7). Moreover, the inner walls of the insertion holes 241, 301 of each of the second and fifth sockets 24, 30, similar to the insertion hole 221, are further configured with a vertical wall 2411, 3011 and a tilted wall 2412, 3012. Each of the vertical walls 2411, 3011 being perpendicular to the base plate 12, each of the tilted walls 2412 of the second sockets 24 being tilted toward the supporting frame 7, each of the tilted walls 3012 of the fifth sockets 30 being tilted toward the first socket 22, so that the elastic rods 4, 5 inserted between the fifth sockets 30 and the second sockets 24 are corresponding to the base plate 12 in a tilted way.

Figure 8:
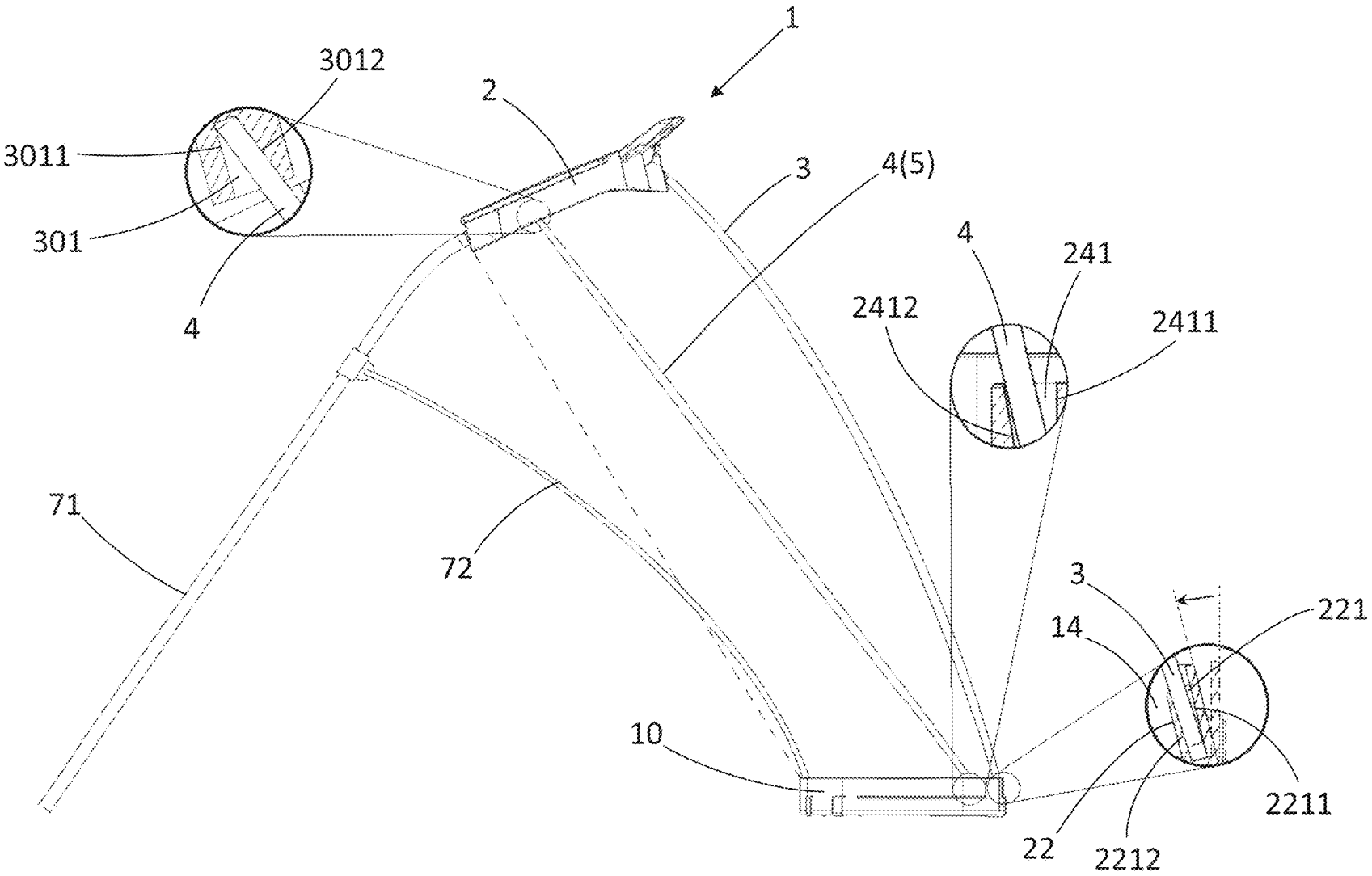
FIG. 8 is a schematic view of the open supporting frame of a golf bag according to a preferred embodiment of the invention.

Thus, when the user wants the golf bag 1 to stand on the ground in a tilted way, the operation is similar to the conventional golf bag. After placing the underframe 10 on the ground, pull the two supporting rods 71 of the supporting frame 7 outward. When pulling the two supporting rods 71, as the wall part 14 and the base plate 12 between the two slits 16 can bend elastically, the head frame 2, the elastic rods 3, 4, 5 and the bag body 6 can tilt toward the two supporting rods 71 (the elastic rods 3, 4, 5 will bend slightly). As soon as the two supporting rods 71 touch the ground, the golf bag 1 can stand on the ground in a tilted way, while the underframe 10 can still be supported on the ground, as shown in FIG. 8.

In other words, based on the structural design of the two slits 16 configured on the two sides of the first socket 22 (for insertion of the elastic rods 3), when the head frame 2, the elastic rods 3, 4, 5 and the bag body 6 are tilted, part of the integrally formed underframe 10 can bend under the elastic force (when the golf bag is tilted, the elastic rods 3 causes the wall part 14 and the base plate 12 between the two slits 16 to bend), so that the two supporting rods 71 can splay out more easily while the head frame 2 and the bag body 6 are tilted. In this way, the golf bag can stand on the ground in a tilted way, as the case in the prior art.

Further, when the golf bag 1 stands on the ground in a tilted way, only a small part of the base plate 12 of the underframe 10 is bent, much of the base plate 12 is still supported on the ground. Therefore, the area of the underframe 10 touching the ground is larger than the folding underframe or the underframe with a driving plate in a conventional golf bag, providing more stability when standing on the ground in a tilted way. Also, because of the integral formation, the production cost will be lower, and the assembly will be easier. Therefore, the product will have more practical value.

Further, with the tilted wall 2212 of the insertion hole 221, the tip end of the elastic rods 3 can have a space for deflection, and the elastic rods 3 can tilt more easily toward the supporting frame 7, so that the stretching angle of the two supporting rods 71 can be enlarged, and the head frame 2 and the bag body 6 can tilt to a larger extent for easier extraction and placing of the golf clubs in the bag body 6.

Further, when the elastic rods 4, 5 are tilted gradually along with the stretch of the two supporting rods 71, because of the tilted walls 2212, 2412, 3012 inside each of the insertion holes 221, 241, 301, the two ends of each of the elastic rods 3, 4, 5 both have a space for slight deflection. Therefore, when each of the elastic rods 3, 4, 5 starts to tilt, each of the insertion holes 221, 241, 301 will not produce a resistance force to limit the inclination of the elastic rods 3, 4, 5, enabling the two supporting rods 71 to splay out more easily. Comparing to the vertical insertion holes on the head frame and underframe in the conventional golf bag for inserting the elastic rods, when tilting the golf bag 1 disclosed in the present invention, there is no need to firstly overcome the resistance of the insertion holes to limit the elastic rods, and the operation is more convenient.

Further, based on the structural design that each of the second sockets 24 and fifth sockets 30 are opposite each other in a tilted way, and each of the fifth sockets 30 is close to the supporting frame 7, when the golf bag 1 is tilted, due to the shortened distance between each of the second sockets 24 and the fifth sockets 30 (when the golf bag 1 is tilted, the head frame 2 will sink slightly), the elastic rods 4, 5 will bend toward the two supporting rods 71. An appropriate elastic force generated by the bending can help retreat the two supporting rods 71, thus facilitating the effort of the user when retreating the two supporting rods 71.

Further, when the golf bag 1 is carried by the user, even if the head frame 2, the underframe 10 and the bag body 6 have slight deformation under the pressure from the weight of the golf clubs (the bag body 6 is bent slightly toward the supporting frame 7 away from the strap, resulting in shortened distance between the head frame 2 and the underframe 10), the elastic rods 4, 5 of the present invention will not deform easily because of the structural design that the elastic rods 4, 5 is tilted toward the supporting frame 7 and each of the insertion holes 241, 301 is provided with tilted walls 2412, 3012 to have a space for deflection, even if the bag body 6 is slightly bent, and the distance between the head frame 2 and the underframe 10 is slightly shortened. This effectively solves the shortcoming of the conventional golf bag that, when carried by the user, the two supporting rods may automatically splay out under the elastic force of the bent elastic rods.

It is to be noted that, due to the limitation of the bag body 6 connected between the head frame 2 and the underframe 10, each of the elastic rods 3, 4, 5 will not fall out of each of the first, second sockets 22, 24 and the fourth, fifth sockets 28, 30.

Further, the present invention does not limit the angle of inclination of each of the tilted walls 2212, 2412, 3012 (according to experiments and tests, 5 degrees to 15 degrees are good, but no limitation is set), as long as the stretching angle of the two supporting rods 71 can be enlarged and the elastic rods 4, 5 inserted in each of the second, fifth sockets 24, 30 can bend slightly when the golf bag 1 is tilted and can generate an appropriate elastic force to help retreat the two supporting rods 71.

Further, the present invention does not limit the parallelism between the two slits 16 or the perpendicularity between its direction of extension and the base plate 12, as long as the underframe 10 is provided with a part to bend elastically when the elastic rods 3 are tilted so that the two supporting rods 71 can touch the ground, and the golf bag 1 can stand on the ground in a tilted way, as required by the present invention.

In summary, based on an innovative structure with two slits provided on the two sides of the first socket, the underframe disclosed in the present invention can realize the functional effect of the underframe of a conventional inclinable golf bag, together with lower production cost and easier assembly; Secondly, the tilted wall of the insertion hole can increase the stretching angles of two supporting rods, so that the golf bag can tilt in a larger angle for easier extraction and placing of the golf clubs. Moreover, with each of the second and fifth sockets being opposite each other in a tilted way and the inner walls of the insertion holes respectively provided with tilted walls, the two supporting rods can be pulled out or retreated more conveniently and easily. The invention truly provides a high practical value.

While the means of specific embodiments in the present invention have been described by reference drawings, numerous modifications and variations could be made thereto by those skilled in the art without departing from the scope and spirit of the invention set forth in the claims. The modifications and variations should be in a range limited by the specification of the present invention.

What is claimed is:

1. An improved underframe, connected to a bag body of a golf bag, for fitting a plurality of elastic rods and a supporting frame of the golf bag, comprising:

a base plate, for support on the ground, a wall part, configured around the base plate, a first socket and two second sockets, configured at three positions on an inner side of the wall part, for insertion of one end of each of the elastic rods, specifically, the first socket is located on one side of the underframe away from the supporting frame, two sides of the first socket are provided with two slits, the two slits extend from a top side of the wall part to the base plate, so that the first socket, the wall part and the base plate between the two slits can move elastically, and two sealing components, respectively connecting the wall part and the base plate in a flexible manner to block the two slits.

2. The improved underframe defined in claim 1, wherein the two sealing components are made of an elastic material other than that of the underframe.

3. The improved underframe defined in claim 1, wherein the two slits extend in parallel from a top side of the wall part to the base plate.

4. The improved underframe defined in claim 3, wherein the two slits are opposite an edge of a vertical base plate.

5. The improved underframe defined in claim 1, wherein, one end of each of the elastic rods is inserted into an insertion hole configured on the first and second sockets, an inner wall of each of the insertion holes is respectively configured with a vertical wall and a tilted wall, each of the vertical wall being perpendicular to the base plate, each of the tilted wall being tilted toward the supporting frame, so that each of the elastic rods can tilt more easily and a stretching angle of the supporting frame can be larger.

6. The golf bag using the improved underframe defined in claim 5, comprising the underframe and a head frame, each of the elastic rods being inserted and connected between each of the first, second sockets and the head frame, the bag body being connected between the underframe and the head frame to cover each of the elastic rods, the supporting frame being configured on one side of the bag body, able to splay out in relation to the bag body to support the bag body to stand on the ground in a tilted way or to be retreated and positioned on one side of the bag body.

7. The golf bag defined in claim 6, wherein inner sides of the head frame are respectively configured with a fourth socket and two fifth sockets to correspond to the first socket and each of the second sockets, each of the elastic rods being inserted and connected between the insertion hole of each of the fourth and fifth sockets and the first and second sockets, inner walls of each of the insertion hole are respectively configured with a vertical wall and a tilted wall, each of the vertical wall being perpendicular to the base plate, each of the tilted wall tilts toward each of the second sockets, so that each of the elastic rods can tilt more easily to increase a stretching angle of the supporting frame.

8. The golf bag defined in claim 7, wherein the two fifth sockets are respectively opposite each of the second sockets, so that each of the elastic rods inserted and connected between each of the fifth sockets and second sockets are corresponding to the base plate in a tilted way.

9. The improved underframe defined in claim 1, which further comprises a third socket, configured on an inner side of the wall part corresponding to a position of the supporting frame, for insertion of one end of the supporting frame.

10. The golf bag using the improved underframe defined in claim 9, comprising the underframe and a head frame, each of the elastic rods being inserted and connected between each of the first, second sockets and the head frame, the bag body is connected between the underframe and the head frame to cover each of the elastic rods, the supporting frame being configured on one side of the bag body, able to splay out in relation to the bag body to support the bag body to stand on the ground in a tilted way or be retreated and positioned on one side of the bag body.

11. The golf bag defined in claim 10, wherein inner sides of the head frame are respectively configured with a fourth socket and two fifth sockets to correspond to the first socket and each of the second sockets, each of the elastic rods being inserted and connected between the insertion hole of each of the fourth, fifth sockets and the first, second sockets, the inner sides of each of the insertion hole are respectively configured with a vertical wall and a tilted wall, each of the vertical wall being perpendicular to the base plate, each of the tilted wall being tilted toward each of the second sockets, so that each of the elastic rods can tilt more easily to increase a stretching angle of the supporting frame.

12. The golf bag using the improved underframe defined in claim 1, comprising the underframe and a head frame, each of the elastic rods being inserted and connected between each of the first, second sockets and the head frame, the bag body being connected between the underframe and the head frame to cover the elastic rods, the supporting frame being configured on one side of the bag body, able to splay out in relation to the bag body to support the bag body to stand on the ground in a tilted way or to be retreated and positioned on one side of the bag body.

13. The golf bag defined in claim 12, wherein inner sides of the head frame are respectively configured with a fourth socket and two fifth sockets to correspond to the first socket and each of the second sockets, each of the elastic rods being inserted and connected between the insertion hole of each of the fourth and fifth sockets and the first and second sockets, inner walls of each of the insertion hole are respectively configured with a vertical wall and a tilted wall, each of the vertical wall being perpendicular to the base plate, each of the tilted wall tilts toward each of the second sockets, so that each of the elastic rods can tilt more easily to increase a stretching angle of the supporting frame.

14. The golf bag defined in claim 13, wherein the two fifth sockets are respectively opposite each of the second sockets, so that each of the elastic rods inserted and connected between each of the fifth sockets and second sockets are corresponding to the base plate in a tilted way.

15. The golf bag using the improved underframe defined in claim 1, comprising the underframe and a head frame, each of the elastic rods being inserted and connected between each of the first, second sockets and the head frame, the bag body being connected between the underframe and the head frame to cover each of the elastic rods, the supporting frame being configured on one side of the bag body, able to splay out in relation to the bag body to support the bag body to stand on the ground in a tilted way or to be retreated and positioned on one side of the bag body.

16. The golf bag defined in claim 15, wherein inner sides of the head frame are respectively configured with a fourth socket and two fifth sockets to correspond to the first socket and each of the second sockets, each of the elastic rods being inserted and connected between the insertion hole of each of the fourth and fifth sockets and the first and second sockets, inner walls of each of the insertion hole are respectively configured with a vertical wall and a tilted wall, each of the vertical wall being perpendicular to the base plate, each of the tilted wall tilts toward each of the second sockets, so that each of the elastic rods can tilt more easily to increase a stretching angle of the supporting frame.

17. The golf bag defined in claim 16, wherein the two fifth sockets are respectively opposite each of the second sockets, so that each of the elastic rods inserted and connected between each of the fifth sockets and second sockets are corresponding to the base plate in a tilted way.

18. The golf bag defined in claim 16, wherein the supporting frame comprises two supporting rods, two elastic bars, an insert connection block and a tightening component, one end of the two supporting rods being pivoted on the head frame, one end of the two elastic bars being respectively pivoted on the two supporting rods, an opposite end being pivoted on the insert connection block, the insert connection block being inserted in the third socket, the tightening component being connected between the two elastic bars, the two supporting rods being able to splay out in relation to the bag body to support the bag body to stand on the ground in a tilted way or be retreated and positioned on one side of the bag body.

19. An improved underframe, connected to a bag body of a golf bag, for fitting a plurality of elastic rods and a supporting frame of the golf bag, comprising:

a base plate, for support on the ground, a wall part, configured around the base plate, a first socket and two second sockets, configured at three positions on an inner side of the wall part, for insertion of one end of each of the elastic rods, specifically, the first socket is located on one side of the underframe away from the supporting frame, two sides of the first socket are provided with two slits, the two slits extend from a top side of the wall part to the base plate, so that the first socket, the wall part and the base plate between the two slits can move elastically, wherein the two sealing components are made of an elastic material other than that of the underframe.

20. An improved underframe, connected to a bag body of a golf bag, for fitting a plurality of elastic rods and a supporting frame of the golf bag, comprising:

a base plate, for support on the ground, a wall part, configured around the base plate, a first socket and two second sockets, configured at three positions on an inner side of the wall part, for insertion of one end of each of the elastic rods, specifically, the first socket is located on one side of the underframe away from the supporting frame, two sides of the first socket are provided with two slits, the two slits extend from a top side of the wall part to the base plate, so that the first socket, the wall part and the base plate between the two slits can move elastically, wherein, one end of each of the elastic rods is inserted into an insertion hole configured on the first and second sockets, an inner wall of each of the insertion holes is respectively configured with a vertical wall and a tilted wall, each of the vertical wall being perpendicular to the base plate, each of the tilted wall being tilted toward the supporting frame, so that each of the elastic rods can tilt more easily and a stretching angle of the supporting frame can be larger.

* * * * *